US009175376B2

(12) United States Patent
Fujihara et al.

(10) Patent No.: US 9,175,376 B2
(45) Date of Patent: Nov. 3, 2015

(54) METHOD FOR PRODUCING SURFACE-MODIFIED RARE EARTH METAL-BASED SINTERED MAGNET AND SURFACE-MODIFIED RARE EARTH METAL-BASED SINTERED MAGNET

(75) Inventors: Mahoro Fujihara, Osaka (JP); Koshi Yoshimura, Osaka (JP); Atsushi Kikugawa, Osaka (JP)

(73) Assignee: HITACHI METALS, LTD., Tokyo (JP)

( * ) Notice: Subject to any disclaimer, the term of this patent is extended or adjusted under 35 U.S.C. 154(b) by 285 days.

(21) Appl. No.: 12/680,312

(22) PCT Filed: Sep. 26, 2008

(86) PCT No.: PCT/JP2008/067527

§ 371 (c)(1),
(2), (4) Date: Mar. 26, 2010

(87) PCT Pub. No.: WO2009/041639

PCT Pub. Date: Apr. 2, 2009

(65) Prior Publication Data

US 2010/0252145 A1 Oct. 7, 2010

(30) Foreign Application Priority Data

Sep. 27, 2007 (JP) ..... 2007-252624
Mar. 31, 2008 (JP) ..... 2008-091830

(51) Int. Cl.
*H01F 1/055* (2006.01)
*C23C 8/16* (2006.01)
(Continued)

(52) U.S. Cl.
CPC ... *C23C 8/16* (2013.01); *C23C 8/12* (2013.01); *H01F 41/026* (2013.01); *H01F 1/0577* (2013.01)

(58) Field of Classification Search
CPC ..... B22F 2003/248; B22F 2201/03; B22F 2201/05; H01F 1/0577; H01F 41/026; C23C 8/12; C23C 8/16
USPC ..... 148/100, 121–122, 300–303; 419/12, 419/26
See application file for complete search history.

(56) References Cited

U.S. PATENT DOCUMENTS
2008/0202642 A1* 8/2008 Sakamoto et al. ..... 148/525

FOREIGN PATENT DOCUMENTS

JP 2001160508 A 6/2001
JP 2005-210094 A1 8/2005
(Continued)

OTHER PUBLICATIONS
Machine Translation of Japanese Patent Document No. 2006-245064, Pub. Sep. 2006.*
(Continued)

*Primary Examiner* — Jie Yang
*Assistant Examiner* — Xiaowei Su
(74) *Attorney, Agent, or Firm* — Kratz, Quintos & Hanson, LLP

(57) ABSTRACT

An objective of the present invention is to provide a rare earth metal-based sintered magnet having imparted thereto sufficient corrosion resistance by an oxidative heat treatment, which is resistant even in an environment of fluctuating humidity, while suppressing the deterioration of the magnetic characteristics ascribed to the oxidative heat treatment, and to provide a method for producing the same. As a means of achieving the objective above, the surface-modified rare earth metal-based sintered magnet of the present invention is characterized in that the surface-modified part comprises a surface-modified layer comprising at least three layers formed in this order from the inner side of the magnet, a main layer containing R, Fe, B, and oxygen, an amorphous layer containing at least R, Fe, and oxygen, and an outermost layer containing iron oxide comprising mainly hematite as the constituent, and the method for producing the same is characterized in that it comprises a step of applying a heat treatment to a bulk magnet body in the temperature range of from 200° C. to 600° C., under an atmosphere with oxygen partial pressure in a range of from $1\times10^2$ Pa to $1\times10^5$ Pa and water vapor partial pressure in a range of from 0.1 Pa to 1000 Pa (exclusive of 1000 Pa).

3 Claims, 3 Drawing Sheets

(51) Int. Cl.

| | |
|---|---|
| ***C23C 8/12*** | (2006.01) |
| ***H01F 41/02*** | (2006.01) |
| *H01F 1/057* | (2006.01) |

(56) References Cited

FOREIGN PATENT DOCUMENTS

| | | | |
|---|---|---|---|
| JP | 2006-49801 | A1 | 2/2006 |
| JP | 2006-245064 | A1 | 9/2006 |
| JP | 2007-5619 | A1 | 1/2007 |
| JP | 2007-207936 | A1 | 8/2007 |
| JP | 2008-4907 | A1 | 1/2008 |
| JP | 2008-244126 | A1 | 10/2008 |
| WO | WO 2005/096326 | A1 | 10/2005 |

OTHER PUBLICATIONS

Machine Translation of JP 2007-207936, Pub. Aug. 2007.*
Machine Translation of JP 2008-244126, Pub. Oct. 2008.*
International Search Report for International Application No. PCT/JP2008/067527 dated Dec. 9, 2008.
International European Search Report for counterpart Application No. EP 08833133.5, dated Jun. 19, 2015.

* cited by examiner

METHOD FOR PRODUCING SURFACE-MODIFIED RARE EARTH METAL-BASED SINTERED MAGNET AND SURFACE-MODIFIED RARE EARTH METAL-BASED SINTERED MAGNET

TECHNICAL FIELD

The present invention relates to a rare earth metal-based sintered magnet having sufficient corrosion resistance even in an environment of fluctuating humidity such as in the transportation environment and the storage environment that humidity is not controlled, yet excellent in the magnetic characteristics, and to a method for producing the same.

BACKGROUND ART

Rare earth metal-based sintered magnets such as R—Fe—B based sintered magnets represented by an Nd—Fe—B based sintered magnet are widely used nowadays in various fields because they use materials available from abundant and inexpensive resources, and possess high magnetic characteristics; however, since they contain highly reactive rare-earth metal, R, also characteristic is that they are apt to be oxidized and corroded in the ambient. Accordingly, in practical use, a corrosion resistant film such as a metal film or a resin film is generally formed on the surface of the rare earth metal-based sintered magnet. However, in an embodiment in which the magnet is embedded and used inside a component, such as in an IPM (Interior Permanent Magnet) motor, the corrosion resistant film above need not necessarily be formed on the surface of the magnet. Still, as a matter of course, corrosion resistance of a magnet must be ensured for the time period after the production to the embedding of the magnet into the components. Thus, as a method for ensuring corrosion resistance of the rare earth metal-based sintered magnet for the time period above, there has been proposed a method of modifying the surface of the magnet by carrying out a heat treatment under an oxidative atmosphere, and this method has attracted attention as an easy technique for improving corrosion resistance, which is enough to achieve the objective above.

The oxidative atmosphere necessary for carrying out the oxidative heat treatment for a surface modification of the rare earth metal-based sintered magnet may be formed by using oxygen (reference can be made to Patent Literature 1 or Patent Literature 2) or water vapor. For instance, Patent Literatures 3 to 6 describe methods for forming an oxidative atmosphere, which comprises by using water vapor alone, or by using the combination of water vapor and oxygen.

Patent Literature 1: U.S. Pat. No. 2,844,269
Patent Literature 2: JP-A-2002-57052
Patent Literature 3: JP-A-2006-156853
Patent Literature 4: JP-A-2006-210864
Patent Literature 5: JP-A-2007-103523
Patent Literature 6: JP-A-2007-207936

DISCLOSURE OF THE INVENTION

Problems that the Invention is to Solve

The corrosion of the rare earth metal-based sintered magnet which occurs during the period after the production to the embedding of the magnet into the components depends on whether the environment in which the magnet is placed is good or bad. In particular, the fluctuation in humidity repeatedly causes fine dew condensation on the surface of the magnet as to accelerate the corrosion of the magnet. The present inventors have validated the utility of the easy techniques for improving corrosion resistance as described in the above Patent Literatures, and as a result, they have found that the techniques above do not always provide sufficient corrosion resistance under an environment of highly fluctuating humidity, and that although the techniques described in Patent Literatures 3 to 6 claim a preferred water vapor partial pressure of 10 hPa (1000 Pa) or higher, it was verified that the heat treatment conducted under such a high water vapor partial pressure atmosphere causes oxidative reaction on the surface of the magnet as to generate hydrogen as by-products in large amount, resulting in the deterioration of the magnetic characteristics due to the embrittlement of the magnet caused by the occlusion of the thus generated hydrogen.

Accordingly, an objective of the present invention is to provide a rare earth metal-based sintered magnet having imparted thereto sufficient corrosion resistance by an oxidative heat treatment, which is resistant even in an environment of fluctuating humidity, while suppressing the deterioration of the magnetic characteristics ascribed to the oxidative heat treatment, and to provide a method for producing the same.

Means for Solving the Problems

In the light of the above circumstances, intensive studies have been made by the present inventors, and as a result, it has been found that a rare earth metal-based sintered magnet subjected to a surface modification by a heat treatment under an oxidative atmosphere with properly controlled oxygen partial pressure and water vapor partial pressure of lower than 10 hPa, i.e., under the water vapor partial pressure range disclosed as inappropriate in Patent Literatures 3 to 6, exhibits sufficient corrosion resistance even in an environment of fluctuating humidity, while suppressing the deterioration of the magnetic characteristics ascribed to the heat treatment.

A method for producing a surface-modified rare earth metal-based sintered magnet of the present invention which was accomplished based on the above finding is as described in a first embodiment, characterized in that it comprises a step of applying a heat treatment to a bulk magnet body in the temperature range of from 200° C. to 600° C., under an atmosphere with oxygen partial pressure in a range of from $1\times10^2$ Pa to $1\times10^5$ Pa and water vapor partial pressure in a range of from 0.1 Pa to 1000 Pa (exclusive of 1000 Pa).

The method described in a second embodiment is a method as described in the first embodiment, characterized in that the ratio of oxygen partial pressure to water vapor partial pressure (oxygen partial pressure/water vapor partial pressure) is in a range of from 1 to 400.

Further, the method described in a third embodiment is a method as described in the first embodiment, characterized in that the heating from a normal temperature to the heat treatment temperature is carried out under an atmosphere with oxygen partial pressure in a range of from $1\times10^2$ Pa to $1\times10^5$ Pa and water vapor partial pressure in a range of from $1\times10^{-3}$ Pa to 100 Pa.

Furthermore, the method described in a fourth embodiment is a method as described in the first embodiment, characterized in that an additional heat treatment is carried out prior to and/or after the heat treatment, in the temperature range of from 200° C. to 600° C. and under an atmosphere with oxygen partial pressure in a range of from $1\times10^{-2}$ Pa to 50 Pa and water vapor partial pressure in a range of from $1\times10^{-7}$ Pa to $1\times10^{-2}$ Pa.

Moreover, a surface-modified rare earth metal-based sintered magnet of the present invention is as described in a fifth embodiment, characterized in that it is produced by the method as described in the first embodiment, In addition, the magnet described in a sixth embodiment is a magnet as described in the fifth embodiment, characterized in that the surface-modified part comprises a surface-modified layer comprising at least three layers formed in this order from the inner side of the magnet, a main layer containing R, Fe, B, and oxygen, an amorphous layer containing at least R, Fe, and oxygen, and an outermost layer containing iron oxide comprising mainly hematite as the constituent.

Further, a surface-modified rare earth metal-based sintered magnet of the present invention is as described in a seventh embodiment, characterized in that the surface-modified part comprises a surface-modified layer comprising at least three layers formed in this order from the inner side of the magnet, a main layer containing R, Fe, B, and oxygen, an amorphous layer containing at least R, Fe, and oxygen, and an outermost layer containing iron oxide comprising mainly hematite as the constituent.

Additionally, the magnet described in an eighth embodiment is a magnet as described in the seventh embodiment, characterized in that the surface-modified layer has a thickness in a range of from 0.5 μm to 10 μm.

Further, the magnet described in a ninth embodiment is a magnet as described in the seventh embodiment, characterized in that the main layer in the surface-modified layer has a thickness in a range of from 0.4 μm to 9.9 μm.

The magnet described in a tenth embodiment is a magnet as described in the seventh embodiment, characterized in that the amorphous layer in the surface-modified layer has a thickness of 100 μm or less.

The magnet described in an eleventh embodiment is a magnet as described in the seventh embodiment, characterized in that the outermost layer in the surface-modified layer has a thickness in a range of from 10 nm to 300 nm.

Furthermore, the magnet described in a twelfth embodiment is a magnet as described in the seventh embodiment, characterized in that the composition of the main layer in the surface-modified layer as compared with that of the magnet not subjected to a surface modification has a reduced Fe content and an increased oxygen content.

Further, the magnet described in a thirteenth embodiment is a magnet as described in the seventh embodiment, characterized in that the oxygen content of the main layer in the surface-modified layer is in a range of from 2.5 mass % to 15 mass %.

Further, the magnet described in a fourteenth embodiment is a magnet as described in the seventh embodiment, characterized in that the main layer in the surface-modified layer contains an R-enriched layer intermittently elongating in the transverse direction, with a length in a range of from 0.5 μm to 30 μm and a thickness in a range of from 50 nm to 400 μm.

Further, the magnet described in a fifteenth embodiment is a magnet as described in the seventh embodiment, characterized in that the outermost layer in the surface-modified layer contains hematite accounting for 75 mass % or more of iron oxide as the constituent.

Effect of the Invention

According to the present invention, there is provided a rare earth metal-based sintered magnet having imparted thereto sufficient corrosion resistance by an oxidative heat treatment, which is resistant even in an environment of fluctuating humidity, while suppressing the deterioration of the magnetic characteristics ascribed to the oxidative heat treatment, and a method for producing the same.

BEST MODE FOR CARRYING OUT THE INVENTION

Figure 1:
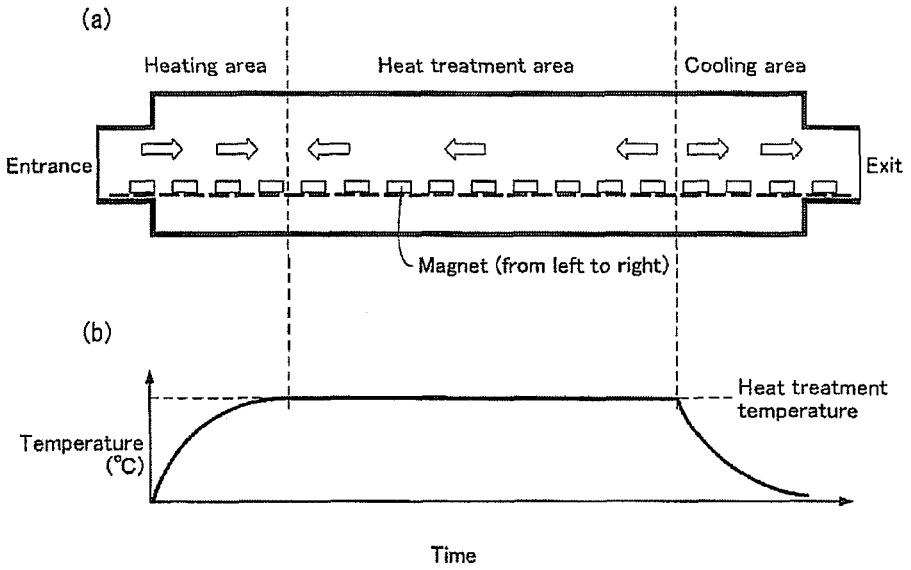
FIG. 1 A schematically view (side view) of an example of a continuous heat-treatment furnace suitable for producing the surface-modified rare earth metal-based sintered magnet according to the present invention.

The method for producing the surface-modified rare earth metal-based sintered magnet of the present invention is characterized in that it comprises a step of applying a heat treatment to a bulk magnet body in the temperature range of from 200° C. to 600° C., under an atmosphere with oxygen partial pressure in a range of from $1\times10^2$ Pa to $1\times10^5$ Pa and water vapor partial pressure in a range of from 0.1 Pa to 1000 Pa (exclusive of 1000 Pa). By carrying out a heat treatment under an oxidative atmosphere with properly controlled oxygen partial pressure and water vapor partial pressure of lower than 10 hPa, a surface modification capable of exhibiting excellent corrosion resistance can be effectively imparted to the magnet, while also suppressing the deterioration of the magnetic characteristics of the magnet, which had been ascribed to the massive generation of hydrogen due to the presence of excessive water vapor.

In order to carry out the desired modification to the surface of the rare earth metal-based sintered magnet in a more effective and a cost-reduced manner, oxygen partial pressure is preferably in a range of from $5\times10^3$ Pa to $5\times10^4$ Pa, and more preferably, from $1\times10^4$ Pa to $4\times10^4$ Pa. Preferably, water vapor partial pressure is set in a range of from 250 Pa to 900 Pa, and more preferably, from 400 Pa to 700 Pa. The ratio of oxygen partial pressure to water vapor partial pressure (oxygen partial pressure/water vapor partial pressure) is preferably in a range of from 1 to 400, and more preferably, from 5 to 100. The oxidative atmosphere inside the treating chamber can be formed, for instance, by individually introducing each of the oxidative gases to give the predetermined partial pressure, or by introducing an atmosphere at a dew point at which the oxidative gases are contained at the predetermined partial pressures. Further, inert gases such as nitrogen and argon may also be present in the treating chamber.

The temperature of the heat treatment is preferably in a range of from 250° C. to 550° C., and more preferably, from 300° C. to 450° C. If the temperature should be too low, the desired modification may not be imparted to the surface of the rare earth metal-based sintered magnet; on the other hand, if the temperature should be too high, the magnetic characteristics of the magnet may be impaired. The time duration of the treatment is preferably in a range of from 1 minute to 3 hours.

The heating from a normal temperature (for instance, in a range of from 10° C. to 30° C.) to the heat treatment temperature is preferably carried out under an atmosphere with oxygen partial pressure in a range of from $1\times10^2$ Pa to $1\times10^5$ Pa and water vapor partial pressure in a range of from $1\times10^{-3}$ Pa to 100 Pa. If the heating process is carried out without atmospheric control, for instance, under air, oxidative reaction occurs on the surface of the magnet during heating by water contained in the atmosphere, thereby resulting in the massive generation of hydrogen which may possibly deteriorate the magnetic characteristics of the magnet. Furthermore, since water content in air is subject to seasonal fluctuation, it is feared that a surface modification of the magnet cannot be provided throughout the year with stable quality. On the other hand, since the atmosphere described above contains proper amount of oxygen and water vapor, the heating process itself favorably influences the surface modification of the magnet, as to contribute to imparting excellent corrosion resistance to the magnet and to suppressing the deterioration of the magnetic characteristics. The heating rate for heating from a normal temperature to the heat treatment temperature is preferably in a range of from 100° C./hour to 1800° C./hour, and the time duration of the heating is preferably in a range of from 20 minutes to 2 hours. Once the magnet is heated to the heat treatment temperature, it may be immediately set to the heat treatment process, or may be kept in the atmosphere of the heating process for some time (for instance, 1 minute to 60 minutes) before setting it to the heat treatment process.

Similarly, the cooling after the heat treatment is preferably carried out under an atmosphere with oxygen partial pressure in a range of from $1\times10^2$ Pa to $1\times10^5$ Pa and water vapor partial pressure in a range of from $1\times10^{-3}$ Pa to 100 Pa. By thus cooling under such an atmosphere, the deterioration of the magnetic characteristics, which is ascribed to a phenomenon such as dew condensation at the surface of the magnet, can be prevented from occurring during the process.

The heating process, the heat treatment process, and the cooling process can be carried out by sequentially changing the environment inside the treating chamber in which the magnet is placed, or by partitioning the treating chamber into areas of each differently controlled environments, and sequentially moving the magnet through each of the areas.

FIG. 1(*a*) is a schematically view (side view) of an example of a continuous heat-treatment furnace in which the inside is partitioned into areas of each differently controlled environments suitable for the heating process, the heat treatment process, and the cooling process, so that the magnet is sequentially moved through each of the areas. In the continuous heat-treatment furnace shown in FIG. 1(*a*), the magnet is transported from left to right of the figure by using a transportation means such as a conveyer belt to apply each of the treatments thereto. An arrow in the figure shows a flow of an atmospheric gas in each area, which is generated by a gas supply means and a gas evacuation means not shown in the figure. The entrance to the heating area and the exit of the cooling area are sectioned, for instance, with an air curtain, and the boundary between the heating area and the heat treatment area as well as the boundary between the heat treatment area and the cooling area are sectioned, for instance, with a flow of an atmospheric gas shown by an arrow (the sectioning can be made mechanically with a shutter). FIG. 1(*b*) is a drawing showing the temperature change of the magnet moving inside the continuous heat-treatment furnace shown in FIG. 1(*a*). By using such a continuous heat-treatment furnace, a surface modification of stable quality can be continuously applied to a large amount of magnets.

The surface-modified layer that is formed on the surface of a rare earth metal-based sintered magnet by the processes above comprises at least three layers formed in this order from the inner side of the magnet, a main layer containing R, Fe, B, and oxygen, an amorphous layer containing at least R, Fe, and oxygen, and an outermost layer containing iron oxide comprising mainly hematite ($\alpha$-$Fe_2O_3$) as the constituent. By comparing the composition of the main layer in the surface-modified layer with that of the magnet not subjected to a surface modification (i.e., raw material), it can be seen that the former is reduced in Fe content and increased in oxygen content; the oxygen content is, for instance, in a range of from 2.5 mass % to 15 mass %. The main layer in the surface-modified layer may sometimes contain an R-enriched layer intermittently elongating in the transverse direction, with a length in a range of from 0.5 μm to 30 μm and a thickness in a range of from 50 nm to 400 nm. Presumably, the R-enriched layer is formed by precipitating Rat the process strained part that was present on the magnet. It is believed to reinforce the magnet whose strength will be decreased by drop of particles, and to contribute to improving the adhesion strength to the component to which the magnet is embedded by using an adhesive. The outermost layer in the surface-modified layer contains iron oxide as the constituent, in which hematite preferably accounts for 75 mass % or higher thereof, more preferably, 80 mass %, and most preferably, 90 mass %. The use of iron oxide containing hematite at a high content ratio and containing magnetite as less as possible contributes to imparting excellent corrosion resistance by applying a surface modification to the magnet. By performing a heat treatment under an oxidative atmosphere with properly controlled oxygen partial pressure and water vapor partial pressure lower than 10 hPa, the outermost layer in the surface-modified layer can be constituted by iron oxide containing hematite at high content ratio. In contrast to above, if a heat treatment should be performed under an atmosphere having high water vapor partial pressure as disclosed in Patent Literatures 3 to 6, iron oxide constituting the outermost layer in the surface-modified layer results in such containing magnetite at high content ratio. It is believed that this fact explains why the magnet subjected to a surface modification according to these Patent Literatures cannot exhibit sufficient corrosion resistance under an environment of highly fluctuating humidity. In addition, the hematite content ratio in iron oxide can be analyzed by, for instance, Raman spectroscopic analysis. The amorphous layer located between the main layer and the outermost layer in the surface-modified layer might have formed as a part in which stable crystal formation had not been accomplished when R and Fe contained in the magnet were converted to form oxides by oxidative reaction.

Further, the thickness of the surface-modified layer formed on the surface of the rare earth metal-based sintered magnet is preferably in a range of from 0.5 μm to 10 μm. If the layer should be too thin, sufficient corrosion resistance may not be exhibited; on the other hand, if the layer should be too thick, it may adversely affect the magnetic characteristics of the magnet. The thickness of the main layer in the surface-modified layer is preferably in a range of from 0.4 μm to 9.9 μm, more preferably, from 1 μm to 7 μm. The thickness of the amorphous layer is preferably 100 nm or less, more preferably, 70 nm or less (the preferred lower limit is, for instance, 10 nm). The thickness of the outermost layer is preferably in a range of from 10 nm to 300 nm, more preferably, from 50 nm to 200 nm.

Furthermore, prior to and/or after the process above, a heat treatment may be carried out in the temperature range of from 200° C. to 600° C., under an atmosphere with oxygen partial pressure in a range of from $1\times10^{-2}$ Pa to 50 Pa and water vapor partial pressure in a range of from $1\times10^{-7}$ Pa to $1\times10^{-2}$ Pa. By adding such a heat treatment, the surface modification can be more surely performed on the rare earth metal-based sintered magnet. The time duration of the treatment is preferably in a range of from 1 minute to 3 hours.

As a rare earth metal-based sintered magnet to which the present invention is applicable, there can be mentioned, for instance, an R—Fe—B-based sintered magnet produced by the production method below.

An alloy containing 25 mass % or higher and 40 mass % or less of a rare earth element R, B (boron) in a range of from 0.6 mass % to 1.6 mass %, and balance Fe and unavoidable impurities is prepared. Here, R may be partially replaced by a heavy rare earth metal RH. Furthermore, a part of B may be replaced by C (carbon), and a part (50 mass % or less) of Fe may be replaced by other transition metal elements (such as Co or Ni). Depending on various objectives, the alloy may further contain at least one of the additive elements M selected from the group consisting of Al, Si, Ti, V, Cr, Mn, Ni, Cu, Zn, Ga, Zr, Nb, Mo, Ag, In, Sn, Hf, Ta, W, Pb, and Bi, at an amount in a range of from about 0.01 to 1.0 mass %.

The alloy above can be favorably prepared by rapid cooling quenching of the melt of the raw material alloy, for instance, by strip casting method. The method for producing a quench-solidified alloy by strip casting method is described below.

Firstly, the raw material alloy having the composition above is molten in an argon atmosphere by radio frequency melting to obtain the melt of the raw material alloy. Then, after holding at around 1350° C., the melt is quenched by single roll method to obtain a flaky alloy ingot having a thickness of, for instance, about 0.3 mm. Prior to the next step of hydrogen pulverizing process, the alloy ingot flake thus prepared is crushed, for instance, into flakes of from 1 to 10 mm in size. The method for producing the raw material alloy by strip casting method is disclosed, for instance, in the specification of U.S. Pat. No. 5,383,978.

[Coarse Pulverizing Process]

The alloy ingot coarsely crushed into flakes as above is placed inside a hydrogen furnace. Then, a hydrogen embrittlement treatment (which may sometimes referred to as "hydrogen pulverizing treatment" or simply "hydrogen treatment" hereinafter) is carried out inside the hydrogen furnace. When the coarsely pulverized alloy powder obtained after the hydrogen pulverizing treatment is taken out from the hydrogen furnace, the action is preferably conducted under an inert atmosphere so that the coarsely pulverized powder might not be brought into contact with air. In this manner, the oxidation and exothermic reaction can be prevented from occurring on the coarsely pulverized powder, and the deterioration of the magnetic characteristics of the magnet can thereby be suppressed.

By the hydrogen pulverizing treatment, the rare earth metal alloy is pulverized to a size in a range of from 0.1 mm to several millimeters, and the average particle size becomes 500 μm or smaller. After the hydrogen pulverizing treatment, preferably, the embrittled raw material alloy is further disintegrated and size-reduced, followed by cooling. In the case of taking out the raw material at a relatively high temperature, the time duration of the cooling treatment can be taken relatively longer.

[Finely Grinding Process]

Then, fine grinding to the coarsely pulverized powder is carried out by using a jet mill grinding apparatus. A cyclone separator is connected to the jet mill grinding apparatus used in the present embodiment. The jet mill grinding apparatus receives supply of the rare earth metal alloy (coarsely pulverized powder) which was coarsely pulverized in the coarse pulverizing process, and the powder is ground inside the grinding apparatus. The powder ground inside the grinding apparatus is collected in a recovery tank via the cyclone separator. In this manner, fine powder having a size in a range of from about 0.1 to 20 μm (typically having an average particle size in a range of from 3 to 5 μm) can be obtained. The grinding apparatus for use in such fine grinding is not only limited to a jet mill, but may be an attritor or a ball mill. Zinc stearate or other lubricants may be used as a grinding aid.

[Press Molding]

In the present embodiment, the particles of the alloy powder prepared by the method above are surface coated with a lubricant, for instance, by adding and mixing a lubricant to the magnetic powder, for instance, for 0.3 wt % in a Rocking mixer. Then, the magnetic powder thus prepared by the method above is molded in an oriented magnetic field by using a known pressing apparatus. The intensity of the applied magnetic field is, for instance, in a range of from 1.5 to 1.7 Tesla (T). Further, the molding pressure is set as such that the green density of the molding body should fall, for instance, in a range of from about 4 to 4.5 g/cm$^3$.

[Sintering Process]

Preferred is to perform sequentially a step of holding the powder molding body above in a temperature range of from 650 to 1000° C. for a time duration of from 10 to 240 minutes and a step of further advancing the sintering at a temperature higher than that of the holding temperature above (for instance, from 1000 to 1200° C.). During the sintering, particularly when the liquid phase is generated (i.e., when the temperature is in a range of from 650 to 1000° C.), the R-rich phase in the grain boundary phase begins to melt to form the liquid phase. Then, a sintered bulk magnet body is formed with progressive sintering. Further, an aging treatment (from 400° C. to 700° C.) or grinding for dimensional adjustment may be performed after the sintering process.

EXAMPLE

The present invention is described in further detail below byway of Examples, but it should be understood that the present invention is not limited thereto. In the following Examples and Comparative Examples, an Nd—Fe—B based sintered magnet prepared by the production method below was used.

An alloy flake from 0.2 to 0.3 mm in thickness and having a composition of Nd: 23.0, Pr: 7.0, Dy: 1.2, B: 1.00, Co: 0.9, Cu: 0.1, Al: 0.2, and balance Fe (unit in mass %) was prepared by strip casting method.

Subsequently, a container was filled with the alloy flakes and was placed inside a hydrogen treatment apparatus. Then, by filling inside the hydrogen treatment apparatus with hydrogen gas at a pressure of 500 kPa, the alloy flakes were subjected to hydrogen occlusion and discharge at room temperature. By thus applying the hydrogen treatment, the alloy flakes were embrittled to obtain irregularly shaped powder having a size in a range of from about 0.15 to 0.2 mm.

After adding and mixing 0.04 wt % of zinc stearate as a grinding aid to the coarsely pulverized powder prepared by the hydrogen treatment above, the resulting mixture was subjected to a grinding process by using a jet mill apparatus to obtain fine powder having a powder particle size of about 3 μm.

The fine powder thus prepared was molded in a pressing apparatus to obtain a powder molding body. More specifically, a press molding was carried out by magnetically orienting the powder particles in an applied magnetic field and pressing. Thereafter, the molding body was taken out of the pressing apparatus, and was subjected to a sintering process in a vacuum furnace at 1050° C. for 4 hours. After thus preparing a sintered body block, the sintered body block was mechanically processed to obtain a sintered magnet having a dimension of 6 mm thickness×7 mm length×7 mm width (referred to hereinafter as "magnet test piece").

Example 1

Figure 2:
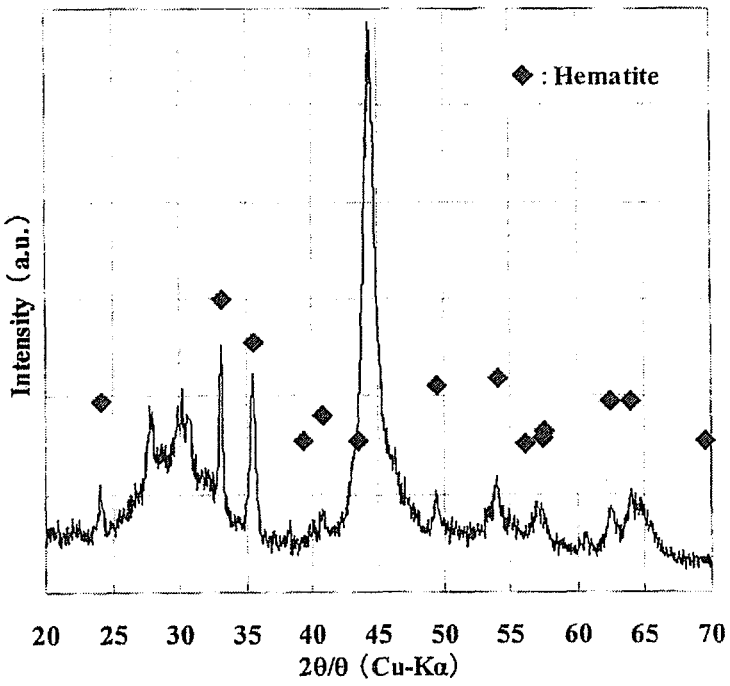
FIG. 2 A chart showing the analytical results of the outermost layer constituting the surface-modified part (surface-modified layer) of the surface-modified magnet test piece of Example 1, obtained by using an X-ray diffraction apparatus and analyzing from the surface thereof.

After an alcohol cleaning, a magnet test piece was subjected to an aging treatment in vacuum at 490° C. for 2.5 hours, and was further subjected to a heat treatment at 400° C. for 15 minutes under an atmosphere containing air having a dew point of 0° C. (with oxygen partial pressure of 20000 Pa and water vapor partial pressure of 600 Pa; oxygen partial pressure/water vapor partial pressure=33.3), to thereby obtain a surface-modified magnet test piece. In the process, the magnet test piece was heated from room temperature to the heat treatment temperature at a heating rate of about 900° C./hour under an atmosphere containing air having a dew point of −40° C. (with oxygen partial pressure of 20000 Pa and water vapor partial pressure of 12.9 Pa) (a heating time duration of 25 minutes). The cooling after the heat treatment was performed under the same atmosphere. The magnet test piece thus obtained was embedded in a resin, polished, and subjected to the preparation of a specimen by using an ion beam cross section polisher (SM 09010: manufactured by JEOL Ltd.). On observing the cross section by using a digital microscope (VHX-200: manufactured by KEYENCE CORPORATION), it was found that the thickness of the modified layer formed on the surface of the magnet test piece is about 2.6 μm, and that the modified layer comprises plural layers containing at least a main layer and an outermost layer having a thickness in a range of from 50 nm to 300 nm. The analytical results of the composition of the main layer in the modified layer and the composition of the raw material (magnet test piece) by using an energy dispersion type X-ray analyzer (Genesis 2000: manufactured by EDAX Inc.) are given in Table 1. As is clearly shown in Table 1, it was found that the main layer in the modified layer contains lower amount of Fe as compared with the raw material, but contains far higher amount of oxygen. Furthermore, by separately using an X-ray diffraction apparatus (RINT 2400: manufactured by Rigaku Corporation), the outermost layer in the modified layer was analyzed from the surface of the surface-modified magnet test piece. The result is given in FIG. 2. As is clearly shown in FIG. 2, the outermost layer in the modified layer was found to be a layer containing hematite as a main component. It was presumed that the outermost layer based on hematite was formed by the heat treatment; a part of the main phase of the raw material was decomposed, and Fe diffused out from the main phase was oxidized to form the layer.

Example 2

After an alcohol cleaning, a magnet test piece was subjected to a heat treatment under the same conditions as in Example 1, and was further subjected to a heat treatment at 500° C. for 5 minutes under an atmosphere with oxygen partial pressure of 5 Pa and water vapor partial pressure of $2.5\times10^{-3}$ Pa to obtain a surface-modified magnet test piece. The magnet test piece was evaluated in the same manner as in Example 1 to find that the modified layer formed on the surface of the magnet test piece has a thickness of about 5.5 μm, and that the constitution thereof is the same as that of the surface-modified magnet test piece obtained in Example 1 (Table 1).

Example 3

After an alcohol cleaning, a magnet test piece was subjected to a heat treatment at 500° C. for 5 minutes under an atmosphere with oxygen partial pressure of 5 Pa and water vapor partial pressure of $2.5\times10^{-3}$ Pa, and was further subjected to a heat treatment under the same conditions as in Example 1 to obtain a surface-modified magnet test piece. The magnet test piece was evaluated in the same manner as in Example 1 to find that the modified layer formed on the surface of the magnet test piece has a thickness of about 4.1 μm, and that the constitution thereof is the same as that of the surface-modified magnet test piece obtained in Example 1 (Table 1).

Example 4

Figure 3:
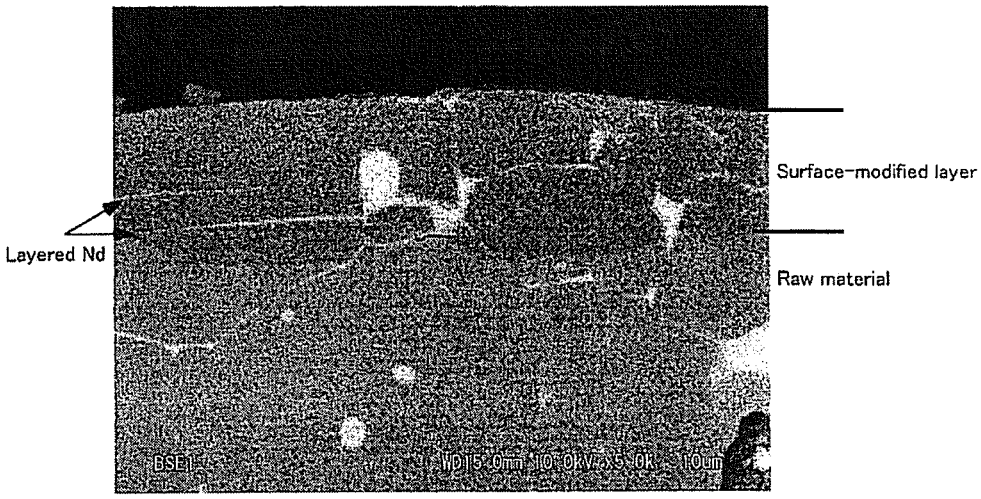
FIG. 3 A micrograph showing the cross section observation result of the surface-modified magnet test piece of Example 4, obtained by using a field emission type scanning electron microscope.
Figure 4:
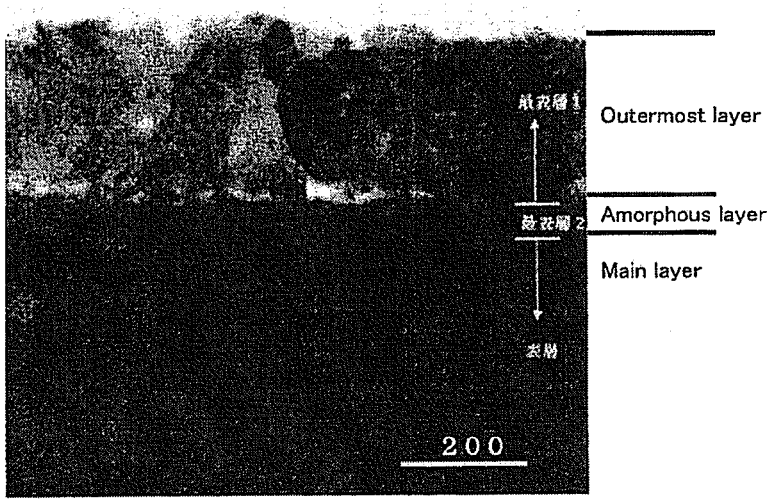
FIG. 4 A micrograph showing the cross section observation result of the surface region of the surface-modified magnet test piece of Example 4, obtained by using a transmission electron microscope (unit: nm).

After an alcohol cleaning, a magnet test piece was subjected to an aging treatment in vacuum at 490° C. for 2.5 hours, and was further subjected to a heat treatment at 400° C. for 2 hours under an atmosphere containing air having a dew point of 0° C. (with oxygen partial pressure of 20000 Pa and water vapor partial pressure of 600 Pa; oxygen partial pressure/water vapor partial pressure=33.3), to thereby obtain a surface-modified magnet test piece. The magnet test piece was heated from room temperature to the heat treatment temperature and cooled after the heat treatment in the same conditions as in Example 1. A specimen was prepared from the magnet test piece in the same manner as in Example 1, and was subjected to a cross section observation by using a field emission type scanning electron microscope (S-4300: manufactured by Hitachi High-Technologies Corporation). The result is given in FIG. 3. As is clearly shown in FIG. 3, it was found that the thickness of the modified layer formed on the surface of the magnet test piece is about 6.1 μm, and that the modified layer comprises plural layers containing at least a main layer and an outermost layer having a thickness of about 200 nm. Furthermore, it was confirmed that, in the modified layer, a layered structure containing Nd having a thickness of about 100 nm and a length of about 5 μm (i.e., an Nd-enriched layer containing 85 mass % or higher of Nd) is formed along the horizontal direction (i.e., in a direction nearly parallel with the surface of the bulk magnet body). The analytical results of the composition of the main layer in the modified layer and the composition of the raw material, which were obtained in the same mariner as in Example 1, are given in Table 1. As is clearly shown in Table 1, it was found that the main layer in the modified layer contains lower amount of Fe as compared with the raw material, but contains far higher amount of oxygen. Furthermore, by separately analyzing the outermost layer in the modified layer in the same manner as in Example 1, it was found that the outermost layer is a layer containing hematite as a main component. Further, a cross section observation in the vicinity of the surface of the surface-modified magnet test piece was made by using a transmission electron microscope (HF 2100: manufactured by Hitachi High-Technologies Corporation). The result is given in FIG. 4 (FIG. 4 is a magnified image of the vicinity of the surface of the modified layer shown in FIG. 3). As is clearly shown in FIG. 4, it was found that a layer about 50 nm in thickness is present between the main phase layer and the outermost layer about 200 nm in thickness. Further, the layer was found to be amorphous (by an electron beam diffraction analysis). The compositions of the amorphous layer and the outermost layer in the modified layer were analyzed by using an energy dispersion type X-ray analyzer (EDX: manufactured by NORAN Instruments), and the results are given in Table 2. As is clearly shown in Table 2, it was found that the outermost layer in the modified layer is constituted by iron oxide almost free of Nd, and that the amorphous layer is made of a complex oxide of Nd and Fe. Furthermore, it was found (by Raman spectroscopic analysis) that hematite accounts for 100 mass % of iron oxide constituting the outermost layer of the modified layer.

TABLE 1

| | | Nd | Dy | Pr | Fe | Co | Al | O |
|---|---|---|---|---|---|---|---|---|
| Example 1 | Main Layer | 15.8 | 7.2 | 5.4 | 62.0 | 1.1 | 0.3 | 8.1 |
| | Raw Material | 16.9 | 8.3 | 5.4 | 66.0 | 1.3 | 0.5 | 1.7 |
| Example 2 | Main Layer | 15.7 | 6.6 | 5.1 | 62.8 | 0.9 | 0.7 | 8.2 |
| | Raw Material | 16.7 | 7.0 | 5.6 | 67.3 | 1.1 | 0.6 | 1.7 |
| Example 3 | Main Layer | 15.6 | 7.2 | 4.9 | 62.3 | 1.1 | 0.7 | 8.2 |
| | Raw Material | 16.6 | 6.8 | 6.0 | 67.2 | 1.1 | 0.7 | 1.7 |
| Example 4 | Main Layer | 15.4 | 7.2 | 4.8 | 63.4 | 0.9 | 0.3 | 8.1 |
| | Raw Material | 17.0 | 6.9 | 5.7 | 67.3 | 1.0 | 0.4 | 1.7 |

(Unit: mass %)

TABLE 2

| | Nd | Fe | O |
|---|---|---|---|
| Outermost Layer | 1.1 | 85.4 | 13.4 |
| Amorphous Layer | 38.7 | 52.0 | 8.7 |

(Unit: mass %)

Comparative Example 1

After an alcohol cleaning, a magnet test piece was subjected to an aging treatment in vacuum at 490° C. for 2.5 hours, and was further subjected to a heat treatment at 400° C. for 15 minutes under an atmosphere containing air having a dew point of 15° C. (with oxygen partial pressure of 20000 Pa and water vapor partial pressure of 2000 Pa), to thereby obtain a surface-modified magnet test piece. The magnet test piece was heated from room temperature to the heat treatment temperature at a heating rate of about 900° C./hour under an atmosphere containing argon having a dew point of −40° C. (with water vapor partial pressure of 12.9 Pa) (a heating time duration of 25 minutes). The cooling after the heat treatment was performed under the same atmosphere. The thickness of the modified layer formed on the surface of the magnet test piece by the treatment above was 3.5 μm.

Comparative Example 2

After an alcohol cleaning, a magnet test piece was subjected to a heat treatment at 500° C. for 30 minutes under an atmosphere with oxygen partial pressure of 100 Pa and water vapor partial pressure of $5\times10^{-2}$ Pa to thereby obtain a surface-modified magnet test piece. The magnet test piece was heated from room temperature to the heat treatment temperature at a heating rate of about 190° C./hour in vacuum (a vacuum degree of $1\times10^{-4}$ Pa or lower) (a heating time duration of 2.5 hours). The cooling after the heat treatment was performed under the same atmosphere. The thickness of the modified layer formed on the surface of the magnet test piece by the treatment above was 8.0 μm.

Comparative Example 3

After an alcohol cleaning, a magnet test piece was subjected to a heat treatment at 500° C. for 1 hour under an atmosphere with oxygen partial pressure of $1\times10^{-4}$ Pa and water vapor partial pressure of $5\times10^{-8}$ Pa to thereby obtain a surface-modified magnet test piece. The magnet test piece was heated from room temperature to the heat treatment temperature and cooled after the heat treatment in the same conditions as in Comparative Example 2. The thickness of the modified layer formed on the surface of the magnet test piece by the treatment above was 0.5 μm.

Comparative Example 4

Figure 5:
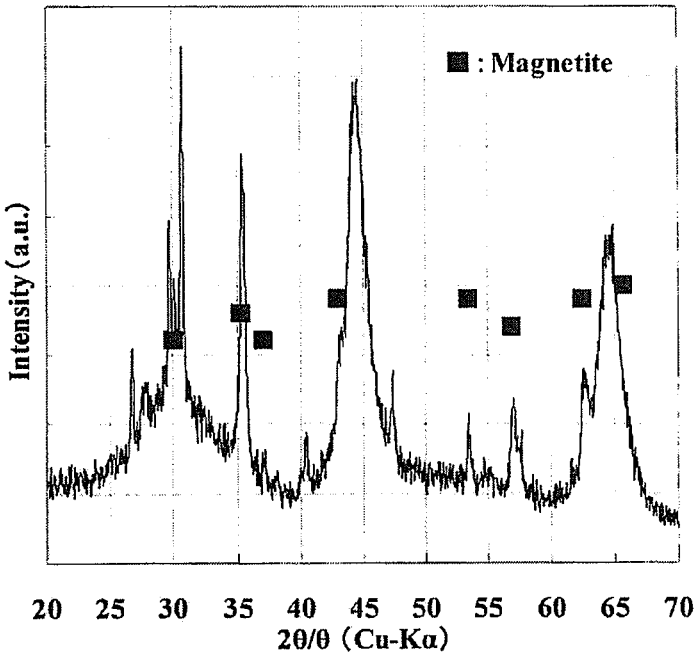
FIG. 5 A chart showing the analytical results of the outermost layer constituting the surface-modified part (surface-modified layer) of the surface-modified magnet test piece of Comparative Example 4, obtained by using an X-ray diffraction apparatus and analyzing from the surface thereof.

After an alcohol cleaning, a magnet test piece was subjected to an aging treatment in vacuum at 490° C. for 2.5 hours, was immersed in an aqueous solution of 2% $HNO_3$ for 2 minutes, and was subjected to ultrasonic rinsing. By further applying a heat treatment at 450° C. for 10 minutes to the magnet test piece under an atmosphere containing nitrogen having a dew point of 40° C. (with water vapor partial pressure of 7000 Pa), a surface-modified magnet test piece was obtained. The magnet test piece was heated from room temperature to the heat treatment temperature at a heating rate of about 1000° C./hour under an atmosphere containing nitrogen having a dew point of −40° C. (with water vapor partial pressure of 12.9 Pa) (a heating time duration of 25 minutes). The cooling after the heat treatment was performed under the same atmosphere. The thickness of the modified layer formed on the surface of the magnet test piece by the treatment above was 7.4 μm. The thickness of the outermost layer in the modified layer was about 100 nm. Separately, the outermost layer in the modified layer was analyzed in the same manner as in Example 1, and the result is given in FIG. 5. As is clearly shown in FIG. 5, the outermost layer in the modified layer was found to be a layer containing magnetite as a main component.

Example 5

After an alcohol cleaning, a magnet test piece was subjected to an aging treatment in vacuum at 490° C. for 2.5 hours, and was further subjected to a heat treatment at 350° C. for 2 hours under an atmosphere containing air having a dew point of 5° C. (with oxygen partial pressure of 20000 Pa and water vapor partial pressure of 875 Pa; oxygen partial pressure/water vapor partial pressure=22.9), to thereby obtain a surface-modified magnet test piece. The magnet test piece was heated from room temperature to the heat treatment temperature at a heating rate of about 800° C./hour under an atmosphere containing air having a dew point of −40° C. (with oxygen partial pressure of 20000 Pa and water vapor partial pressure of 12.9 Pa) (a heating time duration of 25 minutes). The cooling after the heat treatment was performed under the same atmosphere.

Example 6

After an alcohol cleaning, a magnet test piece was subjected to an aging treatment in vacuum at 490° C. for 2.5 hours, and was further subjected to a heat treatment at 350° C. for 2 hours under an atmosphere containing air having a dew point of −10° C. (with oxygen partial pressure of 20000 Pa and water vapor partial pressure of 260 Pa; oxygen partial pressure/water vapor partial pressure=76.9), to thereby obtain a surface-modified magnet test piece. The magnet test piece was heated from room temperature to the heat treatment temperature and cooled after the heat treatment in the same conditions as in Example 5.

Example 7

A surface-modified magnet test piece was obtained in the same manner as in Example 1, except for heating the magnet test piece from room temperature to the heat treatment temperature at a heating rate of about 900° C./hour under an atmosphere containing air having a dew point of −25° C. (with oxygen partial pressure of 20000 Pa and water vapor partial pressure of 63.6 Pa) (a heating time duration of 25 minutes), and cooling after the heat treatment under the same atmosphere.

Example 8

A surface-modified magnet test piece was obtained in the same manner as in Example 1, except for heating the magnet test piece from room temperature to the heat treatment temperature at a heating rate of about 450° C./hour under an atmosphere containing air having a dew point of −40° C. (with oxygen partial pressure of 20000 Pa and water vapor partial pressure of 12.9 Pa) (a heating time duration of 50 minutes), and cooling after the heat treatment under the same atmosphere.

Example 9

After an alcohol cleaning, a sintered magnet having a dimension of 1 mm thickness×7 mm length×7 mm width (the method of production is the same as above) was subjected to an aging treatment in vacuum at 490° C. for 2.5 hours, and was further subjected to a heat treatment at 400° C. for 15 minutes under an atmosphere containing air having a dew point of 0° C. (with oxygen partial pressure of 20000 Pa and water vapor partial pressure of 600 Pa, oxygen partial pressure/water vapor partial pressure=33.3), to thereby modify the surface thereof. The magnet was heated from room temperature to the heat treatment temperature and cooled after the heat treatment in the same conditions as in Example 1.

Comparative Example 5

After an alcohol cleaning, a sintered magnet having a dimension of 1 mm thickness×7 mm length×7 mm width (the method of production is the same as above) was subjected to an aging treatment in vacuum at 490° C. for 2.5 hours, and was further subjected to a heat treatment at 450° C. for 10 minutes under an atmosphere containing nitrogen having a dew point of 40° C. (with water vapor partial pressure of 7000 pa), to thereby modify the surface thereof. The magnet was heated from room temperature to the heat treatment temperature and cooled after the heat treatment in the same conditions as in Comparative Example 4.

Evaluation by Dry and Wet Cycle Test:

By making reference to a cycle test spraying neutral salt water as described in JIS H8502-1999, a dry and wet cycle test excluding spraying salt water (3 cycles) was applied to the surface-modified magnet test pieces obtained in Examples 1 to 8 and in Comparative Examples 1 to 4, and a rating number evaluation after testing (i.e., a corrosion defect evaluation based on JIS H8502-1999) was performed. The results are given in Table 3. In Table 3 is also given the evaluation result for the magnet test piece obtained by an alcohol cleaning and an aging treatment in vacuum at 490° C. for 2.5 hours (Reference Example).

TABLE 3

| | Example Nos. | | | | | | | | Comparative Example Nos. | | | | |
|---|---|---|---|---|---|---|---|---|---|---|---|---|---|
| | 1 | 2 | 3 | 4 | 5 | 6 | 7 | 8 | 1 | 2 | 3 | 4 | Ref. |
| Rating Number | 9.5 | 10 | 9.8 | 10 | 9 | 8 | 9.3 | 9.8 | 6 | 4 | 3 | 4 | 2 |

As is clearly shown in Table 3, the surface-modified magnet test pieces of Examples 1-8 obtained by the method of the present invention showed sufficient corrosion resistance even after the dry and wet cycle test (without any practically problematic deterioration of the magnetic characteristics). It was suggested that the modified layer formed on the surface of the magnet test piece with such a constitution comprising a main layer at least containing oxygen at an amount higher than that of the raw material and an outermost layer containing iron oxide comprising mainly hematite as the constituent contributes to give the results above. Furthermore, the layered structure containing Nd, which was confirmed in the modified layer formed on the surface of the magnet test piece of Example 4, was presumed to be formed upon the partial decomposition of the main phase of the raw material by the heat treatment, in which Nd diffused out from the main phase and precipitated at the strained part that had slightly generated in the modified layer due to a difference in thermal expansion ratio of the raw material and the modified layer. This layered structure containing Nd was also considered to contribute to corrosion resistance of the modified layer.

Figure 6:
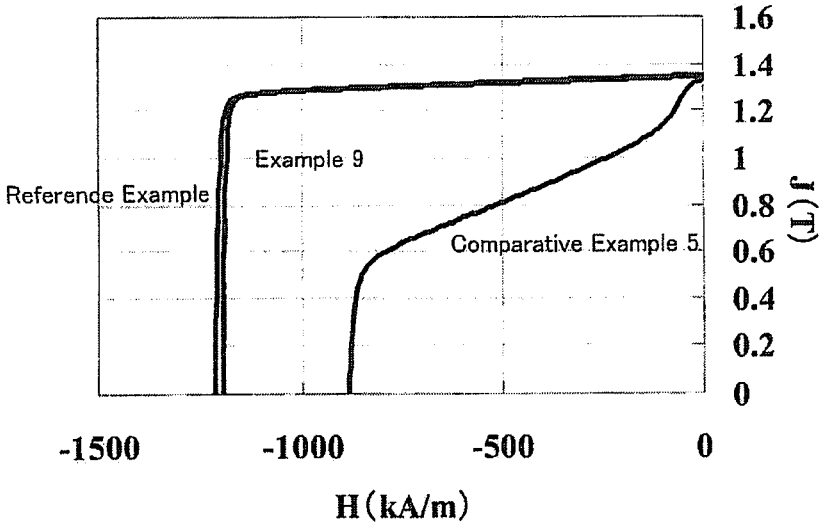
FIG. 6 A graph showing the measured results of the magnetic characteristics of each of the sintered magnets subjected to a surface modification in Example 9 and Comparative Example 5.

Evaluation of Magnetic Characteristics:

The magnetic characteristics of the surface-modified sintered magnets of Example 9 and Comparative Example 5 were measured with a magnetic measurement apparatus (SK-130: manufactured by METRON, Inc.), and the results are shown in FIG. 6. In FIG. 6 is also shown the magnetic characteristics measured on the sintered magnet just after the aging treatment (Reference Example). As is clearly shown in FIG. 6, the surface-modified sintered magnet of Example 9 exhibited no drop at all in the magnetic characteristics attributed to the surface modification, but the surface-modified sintered magnet of Comparative Example 5 suffered considerable drop in the magnetic characteristics attributed to the surface modification. The difference is considered to be ascribed to the fact that in Comparative Example 5, the surface-modified sintered magnet was obtained by the heat treatment under a nitrogen atmosphere free of oxygen and containing water vapor alone in large amount, which led to oxidative reaction on the surface of the magnet as to generate hydrogen as by-products in large amount, resulting in the embrittlement of the magnet caused by the occlusion of the thus generated hydrogen; whereas in Example 9, the surface-modified sintered magnet was obtained by the heat treatment under an atmosphere containing oxygen and water vapor in proper amounts, which led to the suppression of excessive oxidative reaction on the surface of the magnet due to water vapor, thereby preventing hydrogen from generating and completely suppressing hydrogen occlusion from occurring on the magnet.

INDUSTRIAL APPLICABILITY

The present invention has an industrial applicability in the point that it provides a rare earth metal-based sintered magnet having imparted thereto sufficient corrosion resistance by an oxidative heat treatment, which is resistant even in an environment of fluctuating humidity, while suppressing the deterioration of the magnetic characteristics ascribed to the oxidative heat treatment, and a method for producing the same.

The invention claimed is:

1. A method for producing a surface-modified rare earth metal-based sintered magnet, the method comprising a step of:

applying a heat treatment to a rare earth metal-based sintered magnet in the temperature range of from 200° C. to 600° C., under an atmosphere with oxygen partial pressure in a range of from $1\times10^2$ Pa to $1\times10^5$ Pa and water vapor partial pressure in a range of from 250 Pa to 700 Pa, wherein the surface-modified rare earth metal-based sintered magnet comprises a surface-modified part that comprises a surface-modified layer, said surface-modified layer comprising at least:

a main layer containing R, Fe, B, and oxygen, and containing an R-enriched layer with a length in a range of from 0.5 μm to 30 μm and a thickness in a range of from 50 nm to 400 nm, an amorphous layer located outside of the main layer and containing at least R, Fe, and oxygen, and an outermost layer located outside of the amorphous layer and containing iron oxide, wherein the iron oxide is 75 mass % or more hematite.

2. The method as claimed in claim 1, characterized in that the ratio of oxygen partial pressure to water vapor partial pressure (oxygen partial pressure/water vapor partial pressure) is in a range of from 1 to 400.

3. A method for producing a surface-modified rare earth metal-based sintered magnet, the method comprising a step of:

applying a heat treatment to a rare earth metal-based sintered magnet in the temperature range of from 200° C. to 600° C., under an atmosphere with oxygen partial pressure in a range of from $1\times10^2$ Pa to $1\times10^5$ Pa and water vapor partial pressure in a range of from 0.1 Pa to 700 Pa wherein the surface-modified rare earth metal-based sintered magnet comprises a surface-modified part that comprises a surface-modified layer, said surface-modified layer comprising at least:

a main layer containing R, Fe, B, and oxygen, and containing an R-enriched layer with a length in a range of from 0.5 μm to 30 μm and a thickness in a range of from 50 nm to 400 nm, an amorphous layer located outside of the main layer and containing at least R, Fe, and oxygen, and an outermost layer located outside of the amorphous layer and containing iron oxide, wherein the iron oxide is 75 mass % or more hematite, characterized in that an additional heat treatment is carried out prior to and/or after the heat treatment, in the temperature range of from 200° C. to 600° C. and under an atmosphere with oxygen partial pressure in a range of from $1\times10^{-2}$ Pa to 50 Pa and water vapor partial pressure in a range of from $1\times10^{-7}$ Pa to $1\times10^{-2}$ Pa.

* * * * *